United States Patent [19]

Hsu

[11] Patent Number: 4,800,544

[45] Date of Patent: Jan. 24, 1989

[54] AUDIO-ACTUATED DIGITAL CLOCK WITH DOUBLE SELECTIONS

[76] Inventor: Chien-Na Hsu, P.O. Box 96-392, Taipei, Taiwan

[21] Appl. No.: 215,796

[22] Filed: Jul. 6, 1988

[51] Int. Cl.[4] ..... G04C 17/00; G04C 19/00

[52] U.S. Cl. ..... 368/69; 368/82

[58] Field of Search ..... 368/10, 69–70, 368/82, 185–188, 243

[56] References Cited

U.S. PATENT DOCUMENTS

| | | | |
|---|---|---|---|
| 3,871,170 | 3/1975 | Bergey | 368/69 |
| 4,078,376 | 3/1978 | Freeman | 368/73 |
| 4,376,993 | 3/1983 | Freeman | 368/69 |
| 4,635,286 | 1/1987 | Bui et al. | 381/43 |
| 4,670,864 | 6/1987 | Hoffmann | 368/73 |

*Primary Examiner*—Vit W. Miska

[57] ABSTRACT

A digital clock includes: an acoustic-signal receiver and amplifier, a monostable circuit; a display selector consisting of a pair of flip-flops, a pair of display switches respectively controlled by the two flip-flops, a counter controller controlling a light-emitting diode display through a display driver, as switched by the pair of display switches, whereby upon a single clap by a user a time of hours, minutes, and seconds will be displayed, and upon double claps a date of month and day will be displayed, for a convenient time display.

3 Claims, 2 Drawing Sheets

AUDIO-ACTUATED DIGITAL CLOCK WITH DOUBLE SELECTIONS

BACKGROUND OF THE INVENTION

Bergey disclosed a solid state watch display switch in U.S. Pat. No. 3,871,170 in which an arm responsive switch is provided for actuating the display in response to a predetermined movement of the wearer's arm. However, such a switch should be actuated by moving a carrier's arm to mechanically operate an LED display to show a watch time, which is not suitably applicable for a clock since the clock is always hanged on a fixed position.

Bui et al disclosed a speech-controlled electronic watch in U.S. Pat. No. 4,635,286 comprising an electro-acoustic means for converting a pronounced word into an analog signal representing that word, means for transforming the analog signal into a logic control information and means for transforming the logic information into a control signal, such as for controlling a display means of a watch. However Bui's watch still requires a complex structure, a great number of components and higher production cost therefor. It must be effected by a human speech and will not be operated if someone is dumb who cannot give a speech signal to the electro-acoustic system of Bui's device.

The present inventor has found the drawbacks of a conventional watch or timepiece and invented the present digital clock which is actuated by human's clap.

SUMMARY OF THE INVENTION

The object of the present invention is to provide a digital clock including an acoustic-signal receiver and amplifier, a monostable circuit, a display selector consisting of a pair of flip-flops, a pair of display switches respectively controlled by the two flip-flops, a counter controller controlling a light-emitting diode display through a display driver, as switched by the pair of display switches, whereby upon a single clap by a user a time of hours, minutes, and seconds will be displayed, and upon double claps a date of month and day will be displayed, for a convenient time display.

DETAILED DESCRIPTION

Figure 1:
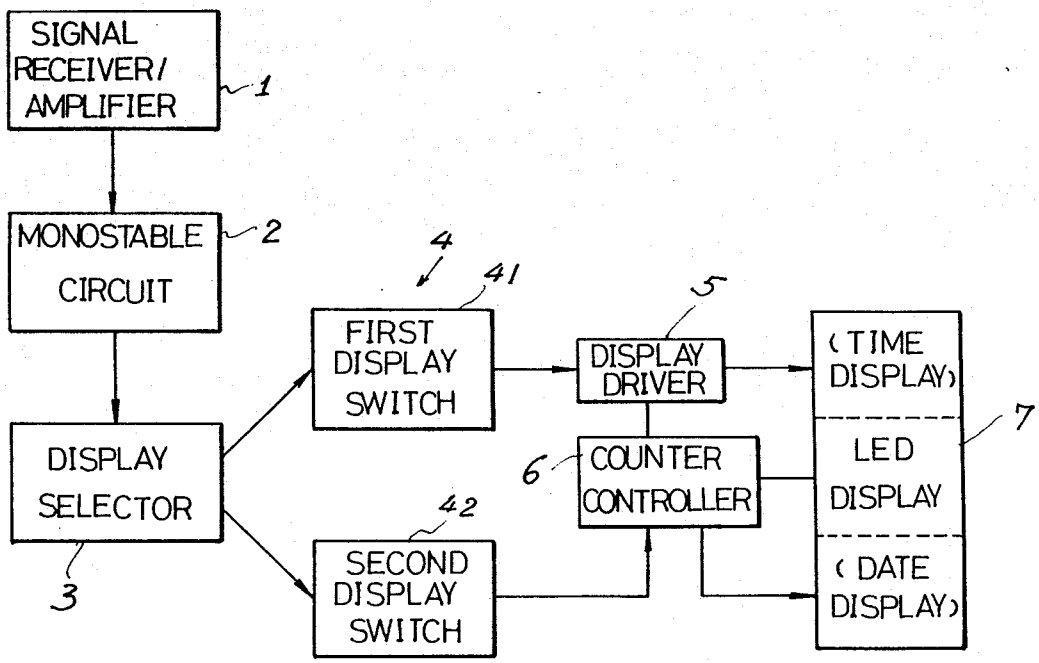
FIG. 1 is a block diagram of the present invention.
Figure 2:
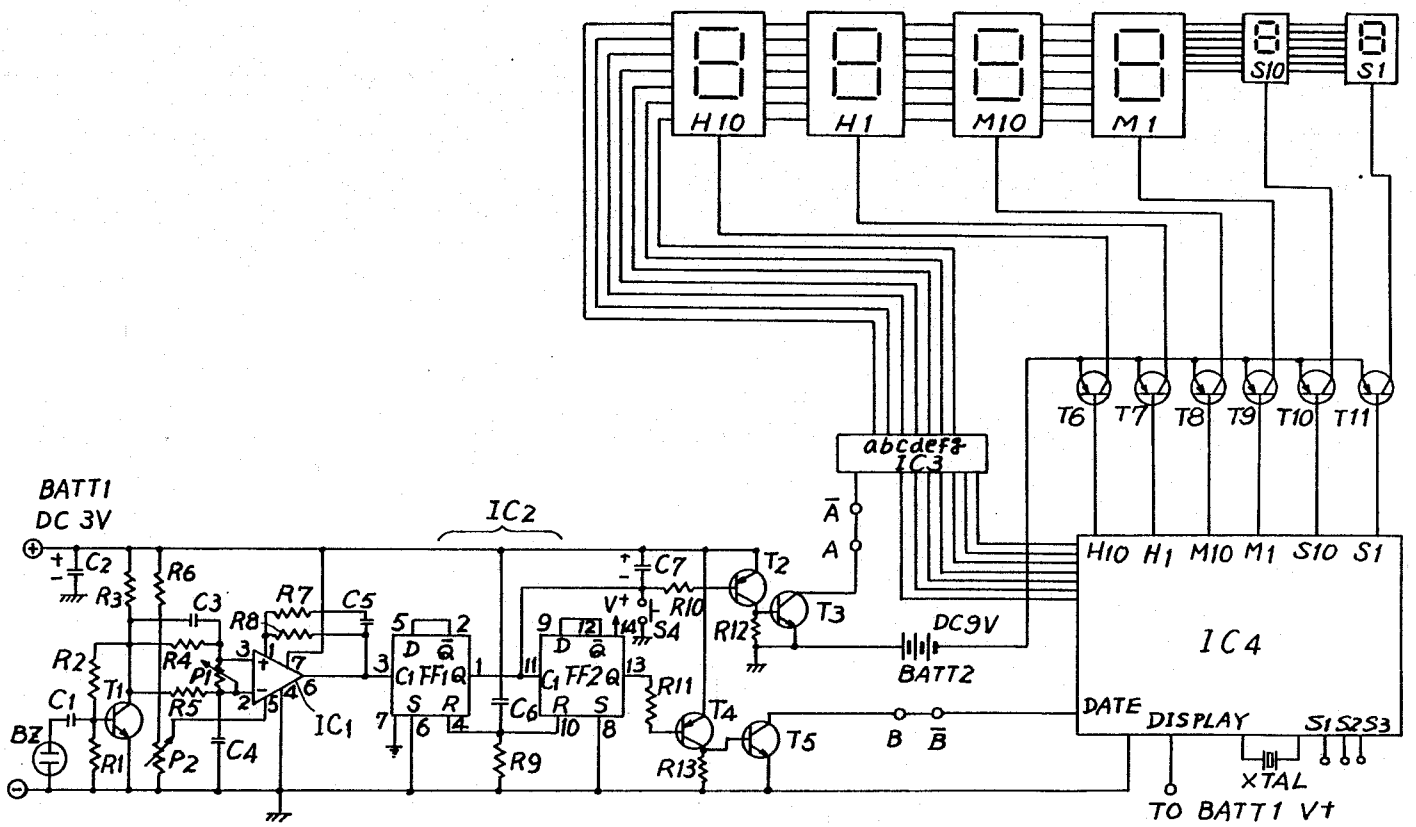
FIG. 2 is an electronic circuit diagram of the present invention.

As shown in the figures, the present invention comprises: an acoustic-signal receiver and amplifier 1, a monostable circuit 2, a display selector 3, a display switch means 4 having a first display switch 41 and a second display switch 42, a display driver 5, a counter controller 6, and a light-emitting diode (LED) digital display means 7.

The acoustic-signal receiver and amplifier 1 includes: a piezo buzzer BZ (or a mike) receiving an acoustic signal such as a human clap sound wave; a signal amplifier having a transistor T1, a capacitor C1 and two resistors R1, R2; and a filter means for filtering off any interference waves by C2, C3, C4, R4 and R5. The acoustic signal is amplified and transmitted into monostable circuit 2.

The monostable circuit 2 is majorly a first integrated circuit IC1 having a comparator and a monostable pulse generator incorporated therein. The signal from the amplifier T1 is transmitted to a comparator for comparing a signal voltage with a standard voltage preset in the comparator for selecting an output signal in a predetermined frequency range to input into the monostable pulse generator for modulating and producing a square wave pulse. The output square-wave pulse may be controlled by a timing circuit having two resistors R7, R8 and a capacitor C5 connected across a pin of IC1 and an input to the display selector 3. For adjusting the operation sensitivity of IC1 a sensitivity adjuster P1 is provided in an input of IC1. P2 is provided for adjusting a trigger potential for the IC1.

The display selector 3 is majorly a second integrated circuit IC2 having a first flip-flop FF1 with its input connected to an output of the IC1 and a second flip-flop FF2 following the FF1. The output of FF1 is connected to a first display switch 41 of the display switch means 4 through a capacitor C7 and a resistor R10 for setting a RC timing constant for time display of hours, minutes and seconds. The output of the second flip-flop FF2 is connected to a second display switch 42.

The display driver 5 (IC3) includes a set of driver transistors a, b, c, d, e, f and g for driving seven bar segments of a LED digital display of the display means 7 when energized by the counter controller (IC4), and another set of switching or strobing transistors T6, T7, T8, T9, T10, and T11 for switching the digital display such as: H10, H1 for hour display; M10, M1 for minute display; and S10, S1 for second display by the strobing signals led to the respective pins on the IC4.

The first display switch 41 includes two transistors T2, T3 connected between an output of FF1 and the IC3. An emitter of T3 is connected to a second power source BATT2 of DC 9 volts which is connected to LED displays means 7 for powering the display means 7. A collector T3 is connected to terminal $A\bar{A}$ of IC3. T2 has a base thereof connected to an output of FF1, and a collector of T2 grounded and connected to a base of T3, and an emitter of T2 connected to positive electrode of a first power source BATT1.

The second display switch 42 includes two transistors T4, T5 connected between an output of FF2 and a trigger pin of "date display" of IC4 through $B\bar{B}$ terminal.

The first power source BATT1 is DC 3 volts for powering the plural integrated circuits of this invention, however, the second power source BATT2 is DC 9 volts for powering LED display 7.

The counter controller 7 further includes: a time base such as a quartz oscillator XTAL for producing clock pulses, S1 for selectively setting a display of time or date manually, S2 for setting a slower time adjustment, S3 for setting a faster time adjustment, and S4 for setting a continuous display for calibrating time.

In using the present invention for indicating a time or date, the following steps are taken:

1. When it is intended to know a time of hours and minutes, a single clap is clapped by a user to exert an acoustic signal which is received and amplified by the amplifier 1, and processed by IC1 for producing a square wave to trigger FF1. The RC constant of C7, R10 may be set to have a duration of 4–5 seconds for the time display.

The output pulse from FF1 will turn on the switch 41 of T2, T3 to connect the second power source BATT2 and terminal $A\bar{A}$ of IC3 to display the time of hours, minutes and seconds.

2. When double claps are actuated, two pulses input the two flip-flops FF1, FF2 will invert to change the output of FF2 to turn on the second switch 42 of T4, T5 to connect the $B\overline{B}$ terminal of "Date Display" of IC4 to display a date of month and day in display means 7.

A RC circuit is provided in IC4 (not shown) for setting a duration of 2–3 seconds for the display of date.

Since the LED display consumes much power energy, the present invention discloses a clap-actuated display system by which the LED is displayed only after receiving an acoustic signal by clapping a user's hands to save electric energy therefor.

Two power sources BATT1, BATT2 are respectively provided for the integrated circuits and for the LED displays, also for saving energy purposes since the ICS require small power energy and the LED display requires larger power energy.

Accordingly, this invention is quite convenient for time or date indication by merely clapping one's hands with single clap or double claps; without a need to move the clock to be superior to Bergey's device; and without incorporating a very complex mechanism as taught by Bui's watch.

I claim:

1. A digital clock comprising:

an acoustic-signal receiver and amplifier operatively receiving and amplifying an acoustic signal by a human clap;

a monostable circuit processing an acoustic signal as transmitted from said signal receiver and amplifier for producing square-wave pulse;

a display selector selectively turning on a display switch means as triggered by said square-wave signal from said monostable circuit; said display selector, said monostable circuit and said amplifier powered by a first power source;

a light-emitting diode digital display means energized and controlled by a counter controller for the display of a time or date;

the display switch means having a first display switch selectively connecting a display driver of said counter controller having a time base therein and a second power source for powering a light-emitting diode digital display means for displaying a time of hours, minutes and seconds thereof, and a second display switch selectively connecting a date-display pin of said counter controller for displaying a date of month and day;

the improvement which comprises:

said display selector including a first flip-flop having an input connected to an output of said monostable circuit and an output connected to said first display switch through a capacitor and a resistor for setting a RC timing constant for the display time duration of hour, minute and second; and a second flip-flop following said first flip-flop having an output of second flip-flop connected to said second display switch; whereby upon a single clap by a user, the first flip-flop will be actuated to turn on said first display switch for displaying the time; and upon double claps, the two flip-flops will be actuated to turn on said second display switch for displaying a date.

2. A digital clock according to claim 1, wherein said first display switch includes a first transistor having its base connected to an output of said first flip-flop, its emitter connected to a positive polarity of said first power source and its collector grounded; and a second transistor having its base connected to said collector of said first transistor, a collector of said second transistor connected to said display driver and an emitter of said second transistor to said second power source of said display means.

3. A digital clock according to claim 1, wherein said second display switch includes a third transistor having its base connected to an output of said second flip-flop, its emitter connected to the positive electrode of said first power source and its collector grounded; and a fourth transistor having a base thereof connected to said collector of said third transistor, an emitter grounded and a collector connected to a pin of date display of said counter controller.

* * * * *